US010190475B2

(12) United States Patent
Nakagawa

(10) Patent No.: US 10,190,475 B2
(45) Date of Patent: Jan. 29, 2019

(54) METHOD FOR MANUFACTURING A DOUBLE PIPE

(71) Applicant: NAKAGAWA SANGYO Co., Ltd., Inuyama-shi (JP)

(72) Inventor: Noriaki Nakagawa, Inuyama (JP)

(73) Assignee: NAKAGAWA SANGYO CO., LTD., Inuyama-Shi (JP)

( * ) Notice: Subject to any disclaimer, the term of this patent is extended or adjusted under 35 U.S.C. 154(b) by 213 days.

(21) Appl. No.: 15/078,222

(22) Filed: Mar. 23, 2016

(65) Prior Publication Data

US 2017/0159538 A1 Jun. 8, 2017

(30) Foreign Application Priority Data

Dec. 4, 2015 (JP) ..... 2015-237034

(51) Int. Cl.
*F01N 13/14* (2010.01)
*B21D 51/16* (2006.01)
(Continued)

(52) U.S. Cl.
CPC ..... *F01N 13/143* (2013.01); *B21D 5/10* (2013.01); *B21D 51/16* (2013.01);
(Continued)

(58) Field of Classification Search
CPC ..... F01N 13/143; F01N 13/1872; F01N 2470/24; F01N 2450/22; F01N 2530/02; B21D 5/10; B21D 51/16
See application file for complete search history.

(56) References Cited

U.S. PATENT DOCUMENTS 4,999,903 A 3/1991 Bujes
2009/0288467 A1 11/2009 Berg
(Continued)

FOREIGN PATENT DOCUMENTS

CN 1299715 A 6/2001
CN 102821886 A 12/2012
(Continued)

OTHER PUBLICATIONS

Office Action from the Chinese Patent Office dated Oct. 13, 2017 in related Chinese application No. 201610139683, and machine translation thereof.

(Continued)

*Primary Examiner* — John C Hong
(74) *Attorney, Agent, or Firm* — J-TEK Law PLLC; Jeffrey D. Tekanic; Scott T. Wakeman

(57) ABSTRACT

A method for manufacturing a double pipe includes: drawing a plate (1), which has a predetermined shape corresponding to the desired final shape of a curved outer pipe (4), into a curved, substantially U-shape in cross-section to produce a half pipe (2). Then, an inner pipe (3), which has a curved shape similar to the desired final curved shape of the outer pipe, is inserted into and positioned within the interior space of the half pipe. Subsequently, the inner pipe is welded to the half pipe at one longitudinal end thereof. Thereafter, longitudinally-extending edges of the half pipe are curled towards each other until they abut and a substantially circular cross-section is formed that surrounds the exterior of the inner pipe. The abutting longitudinally-extending edges (22) of the half pipe are then welded together to produce the curved outer pipe (4).

20 Claims, 5 Drawing Sheets

(51) Int. Cl.
*B21D 5/10* (2006.01)
*F01N 13/18* (2010.01)

(52) U.S. Cl.
CPC ..... *F01N 13/1872* (2013.01); *F01N 2450/22* (2013.01); *F01N 2470/24* (2013.01); *F01N 2530/02* (2013.01)

(56) References Cited

U.S. PATENT DOCUMENTS

| | | | |
|---|---|---|---|
| 2009/0293981 | A1 | 12/2009 | Berg |
| 2013/0256275 | A1 | 10/2013 | Watanabe |

FOREIGN PATENT DOCUMENTS

| | | | |
|---|---|---|---|
| EP | 0639411 | A1 | 2/1995 |
| EP | 0639411 | B2 | 11/2002 |
| JP | S53138967 | A | 12/1978 |
| JP | 60213310 | A | 10/1985 |
| JP | 56149725 | A | 3/1986 |
| JP | 2000051930 | A | 2/2000 |
| JP | 2000202521 | | 7/2000 |
| JP | 2009220182 | A | 10/2009 |

OTHER PUBLICATIONS

Search Report from the Chinese Patent Office dated Sep. 20, 2017 in related Chinese application No. 201610139683, and machine translation thereof.

METHOD FOR MANUFACTURING A DOUBLE PIPE

CROSS-REFERENCE

This application claims priority to Japanese patent application no. 2015-237034 filed on Dec. 4, 2015, the contents of which are incorporated by reference as if fully set forth herein.

BACKGROUND OF THE INVENTION

Field of the Invention

The present invention generally relates to a method for manufacturing a double pipe, such as a method for manufacturing a curved double pipe.

Description of the Related Art

Catalytic converters are utilized, e.g., in vehicles, to convert toxic pollutants, such as carbon monoxide, unburned hydrocarbons and nitrogen oxides, into less toxic or non-toxic substances, such as carbon dioxide, water and nitrogen gas. To perform this purification, catalytic converters utilize a "redox" (i.e. reduction and oxidation) catalyst (purification catalyst) that typically functions most optimally or efficiently at a predetermined temperature or higher. Therefore, to avoid a decrease in the temperature of an exhaust gas flowing from the internal combustion engine (or a similar fuel burning device) into the catalytic converter, an exhaust pipe between the internal combustion engine, etc. and the catalytic converter may include an inner-outer double pipe, in which an air space or clearance is provided between the inner and outer pipes. This air space or clearance serves as an insulator to minimize cooling of the exhaust gas as it flows through the inner pipe to the catalytic converter.

Exhaust pipes typically have a curved shape, because it is necessary to pass the exhaust pipe through narrow spaces underneath the vehicle so as to avoid interference with other parts of the engine, transmission, vehicle chassis, etc. However, if the curved exhaust pipe is formed simply by bending a straight double pipe, the curved portion becomes flattened, which means that a prescribed air space (clearance) can not be reliably and readily formed between the inner pipe and the outer pipe.

As one example for overcoming this flattening problem, Japanese Patent Laid-Open No. 2000-79417 discloses a method for forming a curved double pipe that includes filling a straight double pipe with water and then immersing it in pressurized liquid nitrogen to form ice inside the double pipe. In this frozen state, the entire double pipe is bent by performing a draw-bending process or a similar metal working technique. After the double pipe has been bent, the ice is melted and the water is drained.

Because it is necessary to quickly freeze the water to form the ice, the above-described known manufacturing method incurs additional equipment and material costs due to the use of pressurized liquid nitrogen. Moreover, it involves additional labor costs for the managing (procuring) and handling the liquid nitrogen.

SUMMARY

In view of the above circumstances, it is one object of the present teachings to disclose a relatively simple and cost-effective method for manufacturing a double pipe, e.g., a curved double pipe.

A method according to a first non-limiting aspect of the present teachings includes: drawing a plate (1), which has a predetermined planar shape that at least substantially corresponds to a desired final shape of a curved outer pipe (4), into a curved, substantially U-shape in cross-section, thereby producing a half pipe (curved U-shaped intermediate part) (2); inserting and positioning an inner pipe (3), which has a curved shape similar (corresponding or complementary) to the final curve shape of the outer pipe (4), into an interior space of the half pipe (curved U-shaped intermediate part) (2) having the substantially U-shaped cross-section; welding together the inner pipe (3) and the half pipe (curved U-shaped intermediate part) (2) at one longitudinal end thereof; then bending (curving or curling) longitudinally-extending edges of the half pipe (curved U-shaped intermediate part) (2) so as to cause the longitudinal edges to abut (touch), whereby a substantially circular cross-section is formed that surrounds or encloses the inner pipe; and welding together the abutted longitudinally-extending edges (22), thereby producing the curved outer pipe (4) that seals or encloses (e.g., hermetically seals) the air space (clearance) located around the exterior surface of curved inner pipe (3).

In the first aspect of the present teachings, the inner pipe, which has a curved shape similar (corresponding or complementary) to the curved shaped of the half pipe, is inserted into the interior space of the curved half pipe which was formed into a substantially U-shape in cross-section in the preceding step. Then, the longitudinally-extending edges of the half pipe are bent, curved or curled around the longitudinal centerline of the half pipe so that the longitudinally-extending edges are brought into abutment and a substantially circular shape is formed in a transverse cross-section. As a result, the half pipe surrounds or encloses the exterior of the inner pipe and the curved outer pipe is thus formed. According to such a method, it is possible to easily and cost-effectively manufacture a curved double pipe, e.g., without using ice and liquid nitrogen. Furthermore, because it is not necessary to bend a straight double pipe, flattening or other undesirable deformations of the outer pipe, in particular, can be avoided, thereby ensuring that the prescribed annular gap (air space or clearance) between the inner and outer pipes of the final double pipe can be reliably achieved along the entire length of the double pipe.

In a second aspect of the present teachings, prior to the drawing step, the plate (1) is curved or bent into a predetermined mountain-like (peak) shape along the direction that the double pipe is intended to curve. By performing such a bending step, the subsequent drawing step(s) become(s) easier to perform.

In a third aspect of the present teachings, after the outer pipe (4) has been welded along its longitudinal direction, the diameter of the outer pipe (4) at one longitudinal end (41) thereof is reduced, whereby the inner circumferential surface of the outer pipe (4) is brought into contact with the outer circumferential surface of the inner pipe (3). The longitudinal ends of the inner pipe (3) and outer pipe (4) may then be affixed together, e.g., by welding, so that the inner pipe (3) is fixedly supported or suspended within the outer pipe (4).

In the third aspect of the present teachings, by reducing the diameter end portion (swaged part), the longitudinal end of the double pipe can be easily welded and coupled to another pipe or structure, such as the engine or catalytic converter. Furthermore, by affixing the longitudinal ends of the inner pipe to the corresponding longitudinal ends of the outer pipe, the inner pipe can be suspended and held within the outer pipe in a simple and efficient manner such that the prescribed annular clearance between the inner pipe and the outer pipe is provided. In such an embodiment, the inner pipe contacts the outer pipe only at the longitudinal ends thereof, thereby improving the insulating capabilities of the double pipe.

The reference numbers in parentheses above provide representative, non-limiting examples of structures that may be utilized or formed according to the present methods, as will be further described below in the context of the preferred embodiment. These reference numbers should not be interpreted as limiting the scope of the invention to the preferred embodiment.

By eliminating the need for water and liquid nitrogen in the double pipe manufacturing process, equipment, material and labor costs can be kept down during the manufacture of a curved double pipe.

DETAILED DESCRIPTION OF A PREFERRED EMBODIMENT

The manufacturing method that will be described below is merely a representative, non-limiting example of the present teachings, and various design improvements or modifications, which can made by those skilled in the art without departing from the gist of the present invention, are also intended to be included in the scope of the present invention.

Figure 1:
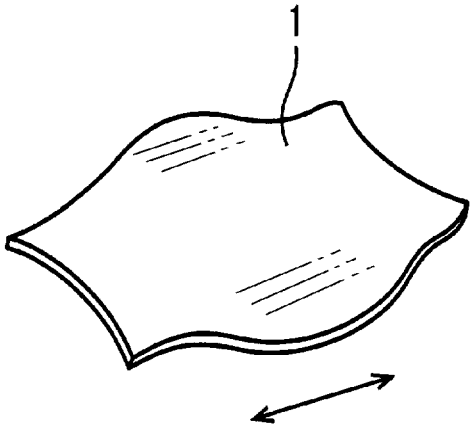
FIG. 1 is a perspective view of a plate or blank according to a first step of a double pipe manufacturing process of the present teachings.

In a representative manufacturing method of the present teachings, a stainless-steel or titanium (or titanium alloy) metal plate 1 is formed into a predetermined shape (blank) by blanking, e.g., cutting or punching, as shown in FIG. 1. The optimal blank shape may be determined empirically such that an outer pipe having a predetermined curved shape can be obtained after the subsequent metal working (shaping) steps. The shape of the blank thus need only be determined once prior to mass production.

Figure 2:
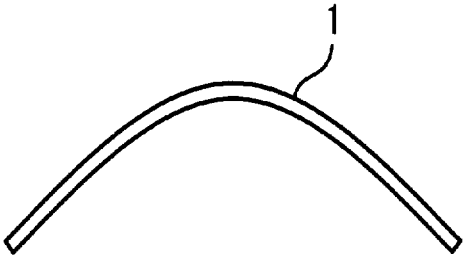
FIG. 2 is a side view of a bent plate formed by bending the planar plate (blank) shown in FIG. 1.
Figure 3:
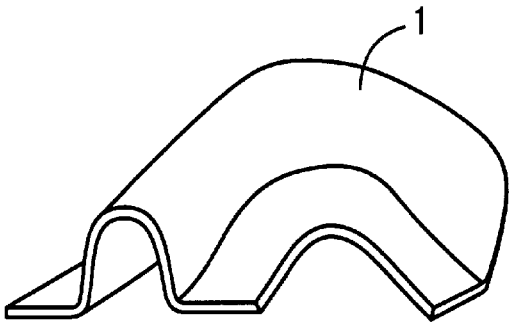
FIG. 3 is a perspective view of a partially-drawn plate after the first stage of a subsequent drawing process.
Figure 4:
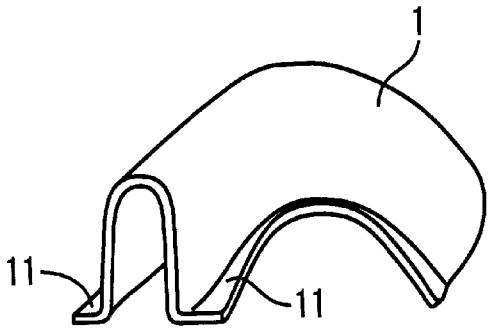
FIG. 4 is a perspective view of a fully-drawn plate (half pipe) after the second stage of the drawing process.
Figure 8:
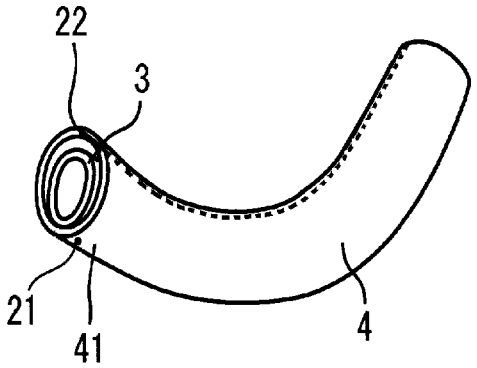
FIG. 8 is a perspective view of an inner-outer double pipe in which the inner pipe is positioned within an outer pipe.

Next, as shown in FIG. 2, the plate (blank) 1 optionally may be bent or deformed (plastically deformed), e.g., by stamping, into a predetermined mountain-like (peak) shape so as to conform to the shape of the drawing (forming) die that will be utilized in the subsequent drawing process. For example, the plate 1 may be bent along the direction (i.e. the direction of the arrow in FIG. 1) of the final bend of the outer pipe after the subsequent shaping steps have been performed. Thus, the plate 1 may be bent or deformed along a straight and/or curved line, depending upon the intended final shape of the outer pipe 4 (see FIG. 8). Thereafter, the planar or bent plate 1 is subjected to a drawing process, in which the plate 1 is stretched and/or compressed into a die by a punch to create a three-dimensional part (i.e. a sheet metal blank 1 is radially drawn into a forming die by the mechanical action of a punch). In case the depth of the drawing is relatively large, the drawing may be performed in multiple steps (e.g., two steps in this embodiment) as shown in FIG. 3 and FIG. 4. Depending upon the dimensions of the plate 1 and the resulting half pipe 2, the drawing process may also be characterized as a "deep drawing" process. As a result of this drawing or deep drawing process, the plate 1 is formed into an inverted U-shape in cross-section, as shown in FIG. 4. It is noted that it is also possible to bend the plate 1 concurrently with drawing process.

Figure 5:
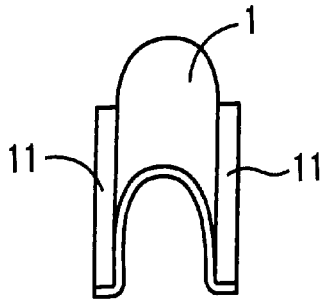
FIG. 5 is an end view of the half pipe of FIG. 4 before trimming.
Figure 6:
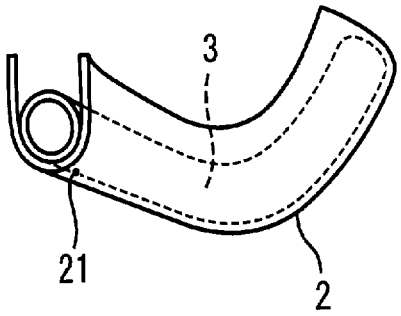
FIG. 6 is a perspective view of the half pipe with an inner pipe inserted within an interior space thereof.

As shown in FIG. 5, after the drawing process, flanges 11 remaining on the two longitudinally-extending side edges of the drawn plate 1 may be removed by trimming to produce a half pipe (curved U-shaped intermediate part) 2 which is curved along its longitudinal direction (longitudinal centerline) and has an inverted U-shaped cross-section. Thereafter, the half pipe 2 is turned (rotated) upside down, and a smaller-diameter inner pipe 3, which is curved in the same direction and to the same extent as the half pipe 2, is inserted into and positioned within the space of (the interior space defined by) the half pipe 2 having the U-shaped cross-section, as shown in FIG. 6. Then, the inner pipe 3 and the half pipe 2 are spot-welded together (reference number 21) at one longitudinal end thereof to affix the two pipes 2, 3 to each other.

Figure 7:
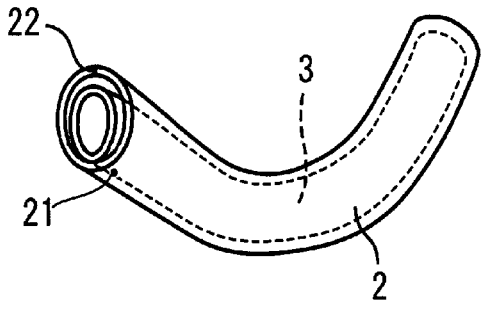
FIG. 7 is a perspective view of the half pipe after it has been bent (curled) into a substantially circular shape in cross-section.

Then, as shown in FIG. 7, the longitudinally-extending edges of the half pipe 2 are bent (curved or curled) around (along) the longitudinal centerline of the half pipe 2 by pressing so that the left and right longitudinally-extending edges of the half pipe 2 come into abutment against each other (reference number 22 in FIG. 7), thereby closing the opening (enclosing the interior space) of the half pipe 2 along the longitudinal direction. In this step, the U-shaped cross-section of the half pipe 2 is transformed into a circular cross-section so as to form the U-shaped half pipe 2 into an enclosed pipe (tubular) shape. Because the inner pipe 3 and the half pipe 2 were spot-welded together at one longitudinal end prior to this bending (curling) step, shifting of the inner pipe 3 relative to the half pipe 2 (outer pipe 4) during the bending step is prevented, and the half pipe 2 is curved so that a predetermined (prescribed) annular (ring-shaped) clearance is provided around the exterior of the inner pipe 3 along the entire longitudinal length of the double pipe. Next, the abutting longitudinally-extending edges 22 of the half pipe 2 are welded together along their length (dashed line in FIG. 8) to produce the (e.g., hermetically sealed) outer pipe 4. The welding may be performed, e.g., using butt welding techniques or seam welding techniques. This welding step completes the curved inner-outer double pipe.

Figure 9:
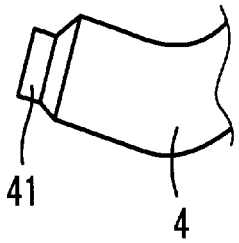
FIG. 9 is a perspective view of one longitudinal end of the inner-outer double pipe after the diameter of the outer pipe has been reduced.

Thereafter, one or both longitudinal ends 41 of the outer pipe 4 optionally may be swaged (reduced in diameter) by pressing, e.g., in a die, whereby the inner circumference (inner circumferential surface) of the outer pipe 4 is brought into contact with the outer circumference (outer circumferential surface) of the inner pipe 3 at this swaged part, as shown in FIG. 9. This process may also be referred to as "necking". The swaged part makes it easier to couple the double pipe to another pipe or another structure by performing three-plate full-circumferential welding or the like. If necessary, the overall shape of the double pipe can be adjusted or modified by restriking to form the final, desired shape of the outer pipe 4.

While the representative embodiment of the present teachings has been described in the context of a double pipe for automobiles, it should be understood that the present teachings are not limited to automobiles and can be advantageously utilized in a variety of fields, including but not limited to trucks, boats, planes, or any other field in which a curved double pipe may be utilized.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved double pipes (double-walled pipes) and methods for manufacturing and using the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Although the term "double pipe" was utilized herein, the structures produced according to the present teachings also may be characterized as "double-walled pipes" that have an annulus (interstitial space) between the diameters of the inner pipe (e.g., primary or carrier pipe) and the outer pipe (e.g. secondary or containment pipe). Furthermore, although stainless steel and titanium were specifically mentioned as materials for the inner and outer pipes, the present teachings are, of course, applicable to any kind of plastically deformable material, including other types of metals and metal alloys, as well as polymers that may be softened for bending, e.g., by raising the temperature thereof. The materials of the inner pipe 3 and the outer pipe 4 may be the same or different.

As was described above, the plate or blank 1 preferably has a predetermined planar shape that at least substantially corresponds to the desired final shape of the curved outer pipe 4. "At least substantially corresponds" is intended to mean that the shape of the plate or blank 1 may be selected such that the curved outer pipe 4 can be formed with some excess material that may be trimmed either before or after the welding step. Naturally, it is preferable, but not mandatory, to minimize the amount of material that must be trimmed from an efficiency standpoint.

Although the inner pipe 3 and outer pipe 4 have smooth inner and outer circumferential surfaces in the preferred embodiment, naturally it is possible to provide projections or other structures on any of the inner or outer surfaces of the inner pipe 3 and/or the outer pipe 4.

For example, if the double pipe is intended to be utilized, e.g., as a heat exchanger or a jacketed pipe, in which heat exchange between fluids (e.g., liquids or gases) in the inner and outer pipes is desirable, the inner pipe and/or the outer pipe may contain projections (e.g., heat conductive projections) extending within the annular clearance between the inner and outer pipes that help to facilitate heat exchange. In such an embodiment, the longitudinal ends are preferably not swaged or affixed to each other, so that a fluid can be introduced into the annular space between the inner and outer pipes. Therefore, the inner pipe may be supported within the outer pipe via one or more projections extending from the outer circumferential surface of the inner pipe to the inner circumferential surface of the outer pipe.

In addition or in the alternative, e.g., in case the double pipe is intended to be used as a double-walled pipe, wherein a dangerous or toxic fluid is transported through the inner pipe and the outer pipe is provided for the purpose of preventing leakages to the surrounding environment in the event that a crack forms in the inner tube, the longitudinal ends may be swaged and/or projections may be provided between the outer circumferential surface of the inner pipe and the inner circumferential surface of the outer pipe, in order to support the inner pipe within the outer pipe.

Although the inner pipe 3 and outer pipe 4 have circular cross-sections in the preferred embodiment, one or both of the inner pipe and outer pipe may have a different cross-section, such as, e.g., oval or polygonal.

What is claimed is:

1. A method for manufacturing a double pipe having a curved inner pipe disposed within a curved outer pipe, the method comprising:

drawing a plate, which has a predetermined shape that at least substantially corresponds to a final shape of the curved outer pipe, into a curved, substantially U-shape in cross-section, thereby producing a curved U-shaped intermediate part;

disposing the curved inner pipe, which has a curved shape that is at least substantially similar to the final shape of the curved outer pipe, in an interior space of the curved U-shaped intermediate part;

welding together the curved inner pipe and the curved U-shaped intermediate part at one longitudinal end thereof;

then bending longitudinally-extending edges of the curved U-shaped intermediate part so that the longitudinally-extending edges come into abutment and an at least substantially circular cross-section is formed, thereby forming the curved outer pipe that encloses the inner pipe; and welding together the abutting longitudinally-extending edges of the curved outer pipe.

2. The method according to claim 1, wherein, prior to the drawing step, the plate is curved into a predetermined peak shape along a direction of the curve of the final shape of the curved outer pipe.

3. The method according to claim 2, further comprising reducing a diameter of a first longitudinal end of the curved outer pipe, and thereby bringing an inner circumferential surface of the curved outer pipe into contact with an outer circumferential surface of the curved inner pipe at the first longitudinal end.

4. The method according to claim 3, further comprising reducing a diameter of a second longitudinal end of the curved outer pipe, and thereby bringing an inner circumferential surface of the curved outer pipe into contact with an outer circumferential surface of the curved inner pipe at the second longitudinal end.

5. The method according to claim 4, wherein the curved inner pipe contacts the curved outer pipe only at the first and second longitudinal ends.

6. The method according to claim 5, wherein the curved inner pipe is welded to the curved U-shaped intermediate part at one longitudinal end thereof by spot welding.

7. The method according to claim 6, wherein the curved inner pipe is not bent in any step after it is disposed in the curved U-shaped intermediate part.

8. The method according to claim 1, wherein the curved inner pipe is not bent in any step after it is disposed in the curved U-shaped intermediate part.

9. The method according to claim 1, wherein the plate is planar when it is subjected to the drawing step.

10. The method according to claim 1, wherein the plate contains at least one bend when it is subjected to the drawing step.

11. The method of claim 1, wherein the longitudinally-extending edges of the curved U-shaped intermediate part are bent while the curved inner pipe is disposed within the curved U-shaped intermediate part so that the longitudinally-extending edges of the curved U-shaped intermediate part come into abutment and enclose the curved inner pipe.

12. A method for manufacturing a double pipe having a curved inner pipe disposed within a curved outer pipe, the method comprising:

subjecting a blank to a drawing process to form a curved U-shaped intermediate part having a substantially U-shape in cross-section;

disposing the curved inner pipe in an interior space defined by the curved U-shaped intermediate part;

spot welding the inner pipe to the curved U-shaped intermediate part at one longitudinal end thereof;

then curling longitudinally-extending edges of the curved U-shaped intermediate part about a longitudinal centerline of the curved U-shaped intermediate part so that the longitudinally-extending edges come into abutment, thereby forming the curved outer pipe that encloses the curved inner pipe; and welding the abutting longitudinally-extending edges of the curved outer pipe.

13. The method according to claim 12, further comprising, prior to the drawing process, bending the blank along a line that is at least partially curved.

14. The method according to claim 12, further comprising, subsequent to welding the abutting longitudinally-extending edges, reducing a diameter of the curved outer pipe at a first longitudinal end thereof so that an inner surface of the curved outer pipe comes into contact with an outer surface of the curved inner pipe.

15. The method according to claim 14, further comprising, subsequent to welding the abutting longitudinally-extending edges, reducing a diameter of the curved outer pipe at a second longitudinal end thereof so that an inner surface of the curved outer pipe comes into contact with an outer surface of the curved inner pipe, wherein the curved inner pipe contacts the curved outer pipe only at the first and second longitudinal ends.

16. The method according to claim 12, wherein the curved inner pipe is not bent in any step after it is disposed in the curved U-shaped intermediate part.

17. The method according to claim 12, wherein the curved inner pipe is welded to the curved U-shaped intermediate part at one longitudinal end thereof by spot welding.

18. A method comprising:

drawing a single plate into a curved intermediate part that is substantially U-shape in cross-section, the curved intermediate part having a first and second longitudinally-extending edge and a first and second longitudinal end and defining a final curve and an interior space;

disposing a curved inner pipe within the interior space, the curved inner pipe having a curved shape that is at least substantially similar to the final curve;

welding together the inner pipe and the curved intermediate part at the first longitudinal end;

then bending the first and second longitudinally-extending edges to come into abutment with each other, forming an at least substantially circular cross-section that encloses the curved inner pipe; and welding together the abutting first and second longitudinally-extending edges to produce a double-pipe having the curved inner pipe disposed within a curved outer pipe.

19. The method according to claim 18, wherein, prior to the drawing step, the plate is curved into a predetermined peak shape along a direction of the curve of the final shape of the curved outer pipe.

20. The method according to claim 18, wherein the curved inner pipe is welded to the curved intermediate part at one longitudinal end thereof by spot welding.

* * * * *